US007733207B2

(12) United States Patent
Yun et al.

(10) Patent No.: US 7,733,207 B2
(45) Date of Patent: Jun. 8, 2010

(54) VERTICALLY FORMED INDUCTOR AND ELECTRONIC DEVICE HAVING THE SAME

(75) Inventors: Ho Gyeong Yun, Seoul (KR); Kwang Seong Choi, Seoul (KR); Jong Tae Moon, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 12/053,716

(22) Filed: Mar. 24, 2008

(65) Prior Publication Data

US 2008/0297299 A1 Dec. 4, 2008

(30) Foreign Application Priority Data

May 31, 2007 (KR) ..... 10-2007-0053172
Jan. 25, 2008 (KR) ..... 10-2008-0007736

(51) Int. Cl.
*H01F 5/00* (2006.01)
*H01F 21/02* (2006.01)
*H01F 27/28* (2006.01)

(52) U.S. Cl. ..... 336/200; 336/147; 336/186; 336/189; 336/223; 336/232

(58) Field of Classification Search ..... None
See application file for complete search history.

(56) References Cited

U.S. PATENT DOCUMENTS 5,349,743 A * 9/1994 Grader et al. ..... 29/602.1
5,612,660 A * 3/1997 Takimoto ..... 336/200
6,031,445 A * 2/2000 Marty et al. ..... 336/200
6,169,470 B1 * 1/2001 Ibata et al. ..... 336/83
6,291,872 B1 * 9/2001 Wang et al. ..... 257/531
6,587,025 B2 * 7/2003 Smith et al. ..... 336/200
6,975,199 B2 * 12/2005 Long et al. ..... 336/200
7,205,876 B2 * 4/2007 Lee et al. ..... 336/200
7,449,987 B2 * 11/2008 Snyder ..... 336/200
2006/0145805 A1 * 7/2006 Kim et al. ..... 336/200
2007/0236319 A1 * 10/2007 Hsu et al. ..... 336/200
2007/0268105 A1 * 11/2007 Walls ..... 336/200

FOREIGN PATENT DOCUMENTS

JP 10-313093 A 11/1998
KR 10-1999-0015740 3/1999
KR 1020030057998 7/2003
KR 1020060078922 7/2006
KR 1020060079805 7/2006
KR 100650907 11/2006

* cited by examiner

*Primary Examiner*—Lincoln Donovan
*Assistant Examiner*—Mangtin Lian
(74) *Attorney, Agent, or Firm*—Rabin & Berdo, P.C.

(57) ABSTRACT

Provided are an inductor, which is vertically formed, and an electronic device having the inductor, and more particularly, an inductor capable of minimizing loss of a surface area and accomplishing high efficiency impedance by vertically forming the inductor in a plurality of insulating layers, and an electronic device having the same. The inductor includes a plurality of conductive lines disposed in the insulating layers; and vias vertically formed in the insulating layers to electrically connect the plurality of conductive lines. When a board or an electronic device including an inductor proposed by the present invention is manufactured, the inductor can occupy a minimum area in the electronic device or board while providing high inductance. In particular, the surface area of the electronic device or board occupied by the inductor can be remarkably decreased to reduce manufacturing costs.

5 Claims, 7 Drawing Sheets

VERTICALLY FORMED INDUCTOR AND ELECTRONIC DEVICE HAVING THE SAME

CROSS-REFERENCE TO RELATED APPLICATION

This application claims the benefit of Korean Patent Application No. 2007-53172, filed May 31, 2007, and No. 2008-7736, filed Jan. 25, 2008, the disclosure of which is hereby incorporated herein by reference in its entirety.

BACKGROUND

1. Field of the Invention

The present invention relates to a vertically formed inductor and an electronic device having the same, and more particularly, to an inductor capable of minimizing loss of a surface area and accomplishing high efficiency impedance by vertically forming the inductor on an insulating layer, and an electronic device having the same.

2. Discussion of Related Art

In recent times, with requirements of high integration of electronic components, a substrate, in which a plurality of layers are stacked, is generally used to perform a packaging process. The reason for performing the packaging process is that a larger number of active and passive components can be mounted on a smaller area. That is, the most important thing in performing the packaging process is that how many various components can be effectively disposed in the smaller area. In particular, a necessary passive device for implementing silicon CMOS technology to a high-frequency integrated circuit is an inductor. The inductor is an important device for performing impedance matching and RF choke in the high-frequency integrated circuit, which occupies the largest area in the integrated circuit.

However, since the impedance is a function of frequency, in order to obtain the same impedance, the magnitude of the inductor is in inverse proportion to the frequency. As a result, an increase in magnitude of the inductor causes an increase in size of the integrated circuit, thereby increasing manufacturing cost. Therefore, recently, various attempts to develop an integrated inductor for providing high inductance with a small size have been performed.

Among the attempts, a method of manufacturing an inductor by disposing a conductive line in a dielectric material is disclosed in Korean Patent Registration No. 0598113, implementing an inductor having high inductance in a limited space by rotating a metal line in a dielectric.

FIGS. 1 to 3 illustrate the constitution of a conventional inductor. FIG. 1 is a schematic perspective view of an electronic device including a linear inductor in accordance with a first embodiment of the conventional art, FIG. 2 is a schematic perspective view of an electronic device including a spiral inductor in accordance with a second embodiment of the conventional art, and FIG. 3 is a schematic perspective view of an electronic device including a meander inductor in accordance with a third embodiment of the conventional art. Referring to FIGS. 1 to 3, a conductive line 12 is formed on an upper surface of an insulating layer 11, 21 or 31 formed on a substrate 10, 20 or 30 in a straight line, a spiral line or a zigzag line having a plurality of meander parts. While not shown, an insulating layer is deposited to cover the conductive line, 12, 22 or 32, after forming the conductive line on the upper surface of the insulating layer 11, 21 or 31.

However, according to the conventional art, since the conductive line is formed on the upper surface of the insulating layer or formed in a direction parallel to the upper surface, the conductive line occupies a larger surface area of the insulating layer. In particular, when the conductive line is formed in a spiral line or a zigzag line, the conductive line occupies a larger surface area of the insulating layer in order to form an inductor having desired impedance. Accordingly, since the direction of the conductive line to be used as the inductor is limited within the upper surface of the insulating layer or in a direction parallel to the upper surface, spatial efficiency is decreased. In addition, since it is needed to widen the surface area of the insulating layer in order to have desired impedance, it is impossible to effectively increase the impedance. In particular, as described above, when the horizontal inductor is disposed on an electronic device or a board, since the wide area occupied by the inductor makes it difficult to integrate other components, it is difficult to effectively constitute the integrated circuit.

SUMMARY OF THE INVENTION

The present invention is directed to an inductor capable of minimizing a loss in surface area by the inductors by vertically disposing inductors on an electronic device or a board, different from the conventional horizontally formed inductors, thereby providing high-efficiency impedance, and an electronic device having the same.

One aspect of the present invention provides an inductor, which is vertically disposed in a plurality of insulating layers formed on a substrate, including: a plurality of first conductive lines disposed in the insulating layers; and vias vertically formed in the insulating layers to electrically connect the plurality of first conductive lines.

Another aspect of the present invention provides an electronic device including: a plurality of insulating layers formed on a substrate; and an inductor vertically disposed in the plurality of insulating layers, wherein the inductor comprises a plurality of first conductive lines disposed in the insulating layers, and vias vertically formed in the insulating layers to electrically connect the plurality of first conductive lines.

BRIEF DESCRIPTION OF THE DRAWINGS

The above and other features of the present invention will be described in reference to certain exemplary embodiments thereof with reference to the attached drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein.

Figure 1:
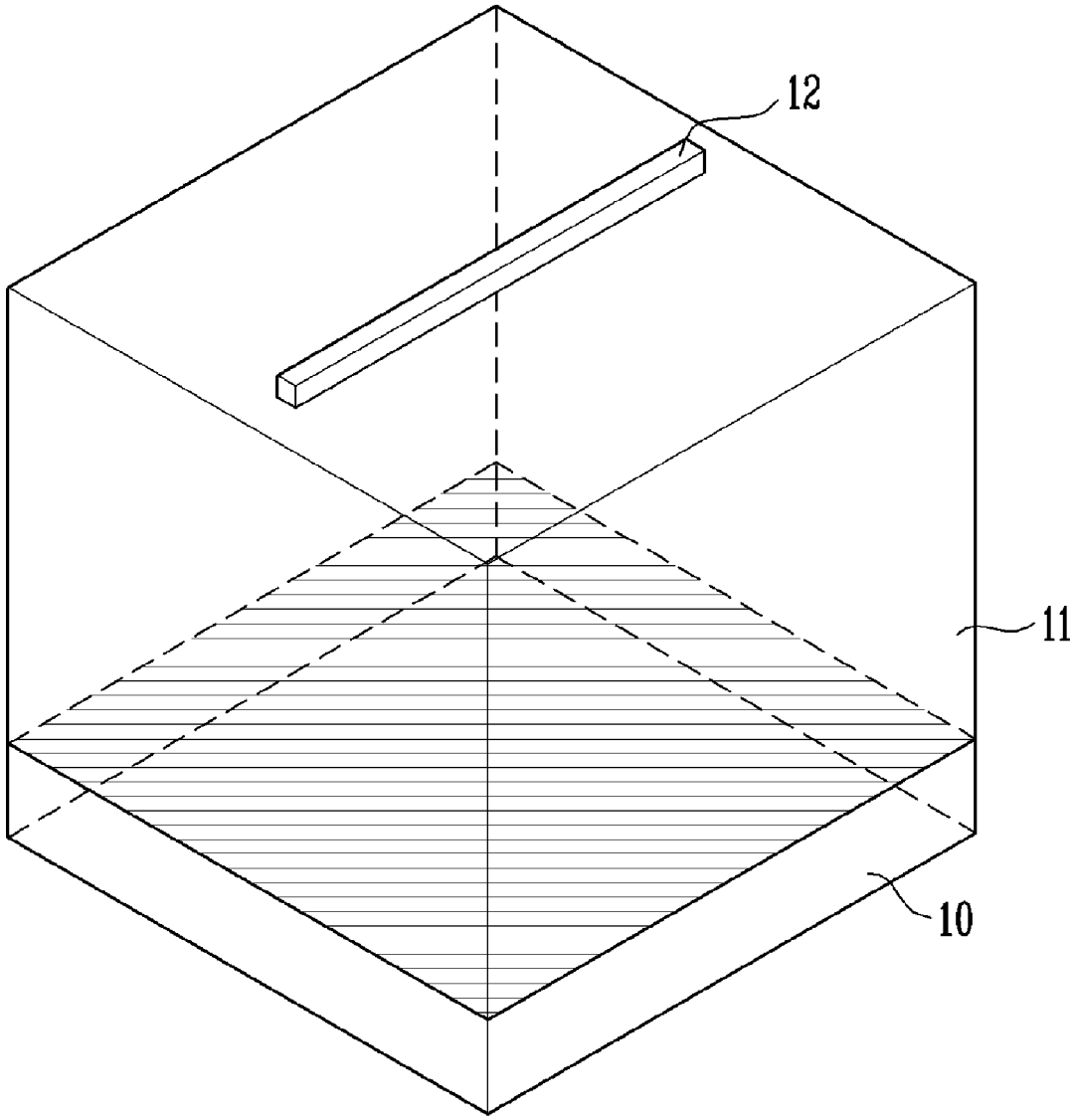
FIG. 1 (PRIOR ART)
FIG. 1 is a schematic perspective view of an electronic device including a linear inductor in accordance with a first embodiment of the conventional art.
Figure 2:
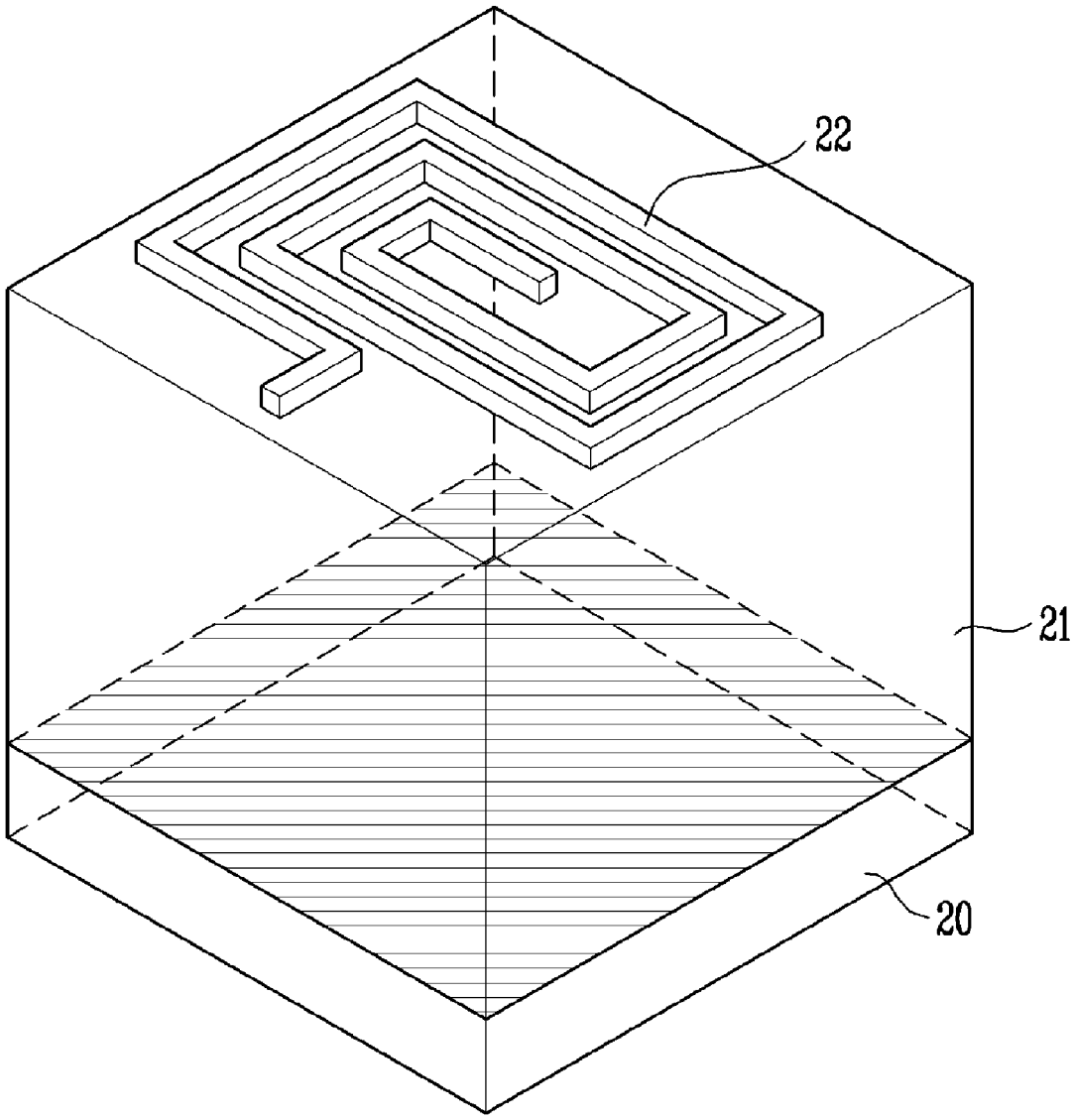
FIG. 2 (PRIOR ART)
FIG. 2 is a schematic perspective view of an electronic device including a spiral inductor in accordance with a second embodiment of the conventional art.
Figure 3:
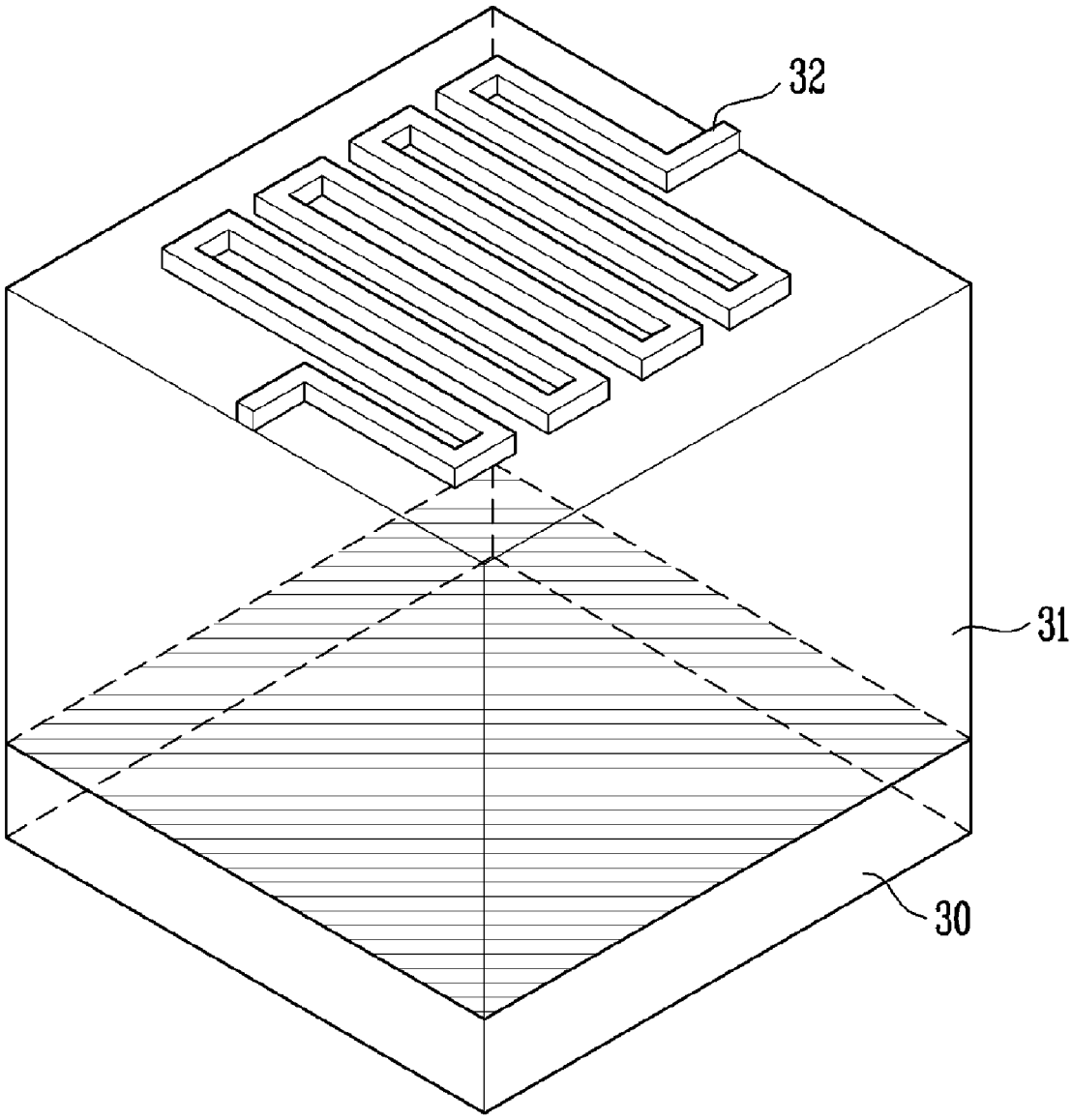
FIG. 3 (PRIOR ART)
FIG. 3 is a schematic perspective view of an electronic device including a meander inductor in accordance with a third embodiment of the conventional art.
Figure 4A:
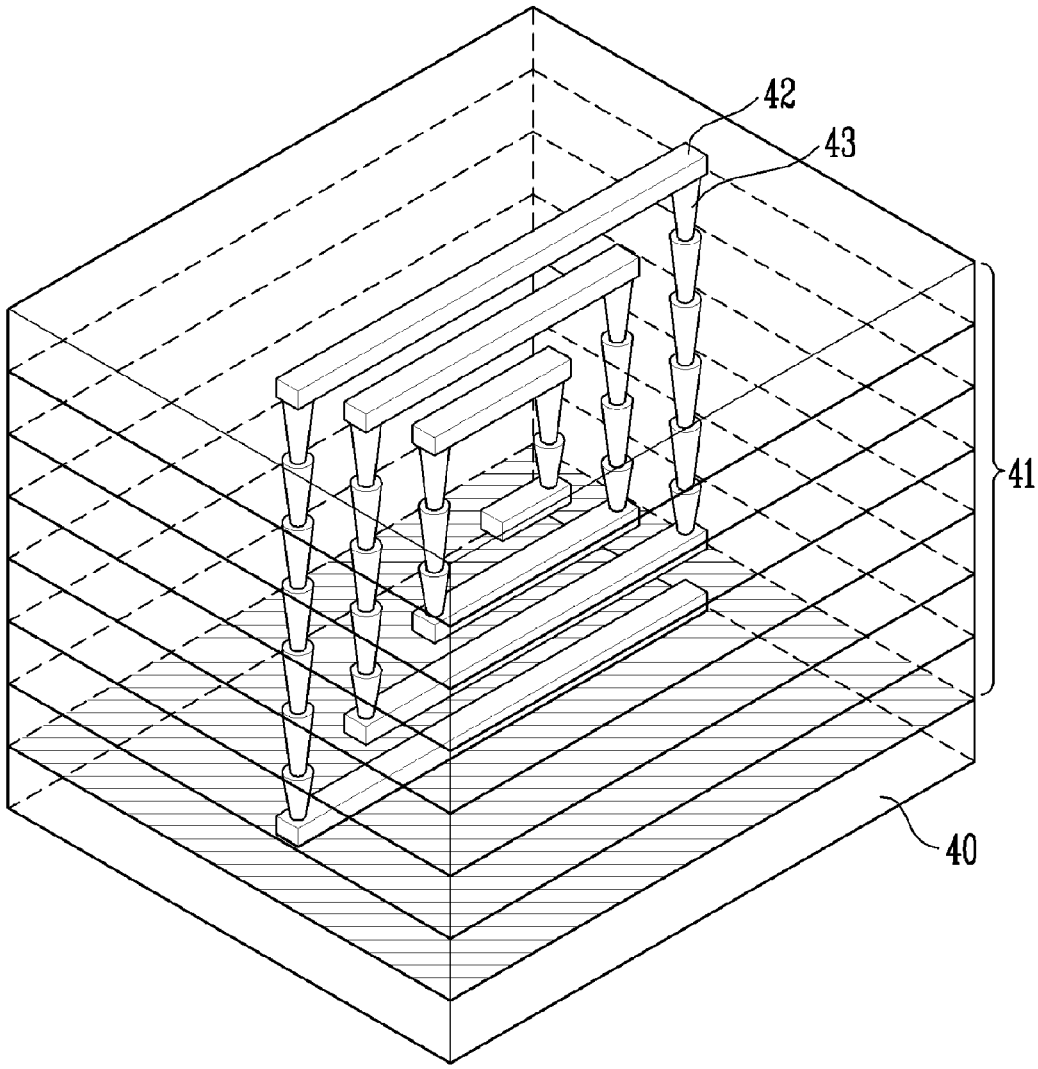
FIG. 4A is a schematic perspective view of an electronic device including a vertically formed spiral inductor in accordance with a first exemplary embodiment of the present invention.
Figure 4B:
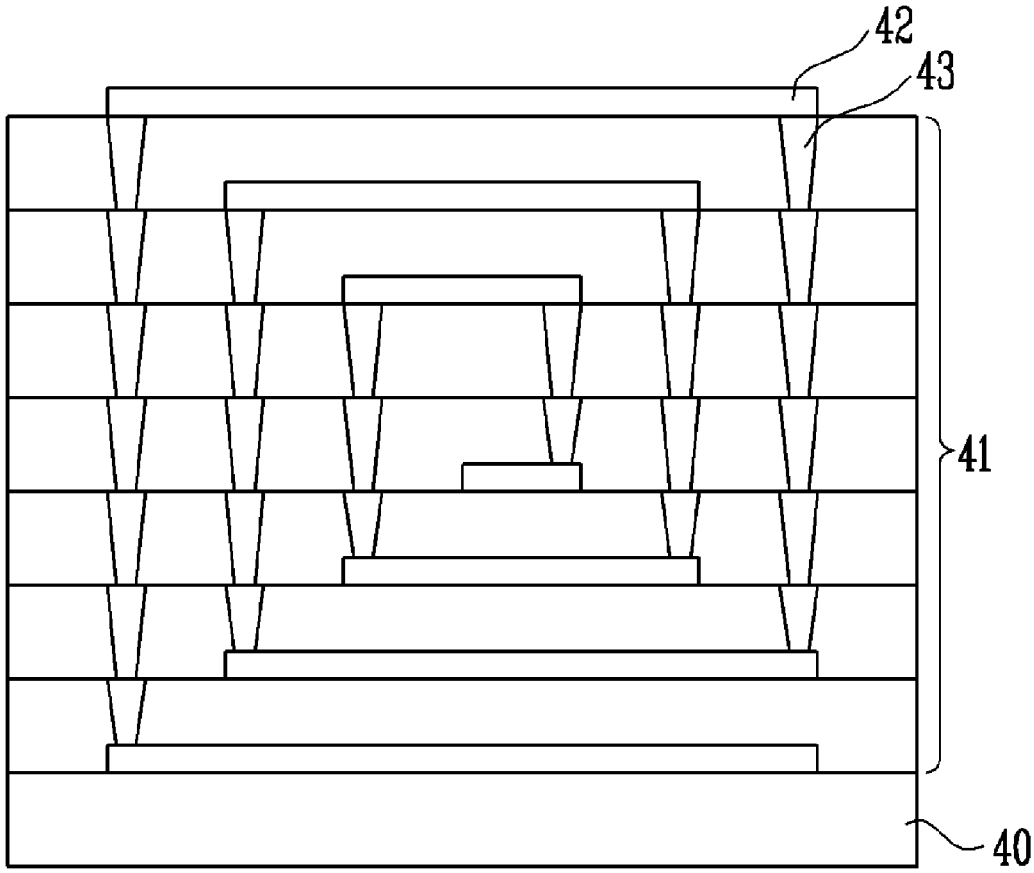
FIG. 4B is a schematic side view of an electronic device including a vertically formed spiral inductor in accordance with the first exemplary embodiment of the present invention.

FIG. 4A is a schematic perspective view of an electronic device including a vertically formed spiral inductor in accordance with a first exemplary embodiment of the present invention, and FIG. 4B is a schematic side view of an electronic device including a vertically formed spiral inductor in accordance with the first exemplary embodiment of the present invention.

Referring to FIGS. 4A and 4B, the inductor in accordance with a first exemplary embodiment of the present invention is formed in a plurality of insulating layers (or dielectric layers) 41 formed on a substrate 40 and perpendicular to the substrate 40. It is difficult to form a conductive line pattern, which is perpendicular to the substrate and functions as an inductor, directly in an insulating layer in a technical aspect. Thus, conductive lines 42 are formed on each of the insulating layers 41 and the conductive lines 42 separated by the insulating layers 41 are connected through vias 43 to form an inductor perpendicular to the substrate 40. Here, the vias 43 correspond to connection lines to connect the conductive lines 42 formed in each of the insulating layers 41, and are conductors formed in each of the insulating layers 41 to pass through upper and lower surfaces of the insulating layers 41. In the first exemplary embodiment of the present invention, the inductor may have a spiral structure, which rotates inward or outward in the insulating layers 41.

For example, in a board having a multi-layered structure such as a printed circuit board (PCB) or a low temperature co-fired ceramic (LTCC), vias are generally used as connection lines between layers. Thus, the inductor perpendicular to a substrate can be easily manufactured using the structure proposed by the present invention.

According to the above embodiments, the inductor is vertically formed, not parallel to an upper surface of the insulating layer, thereby maximizing spatial disposition efficiency in constituting an integrated circuit on the device or the board to maximally obtain a space in which other components are positioned in the integrated circuit.

Figure 5:
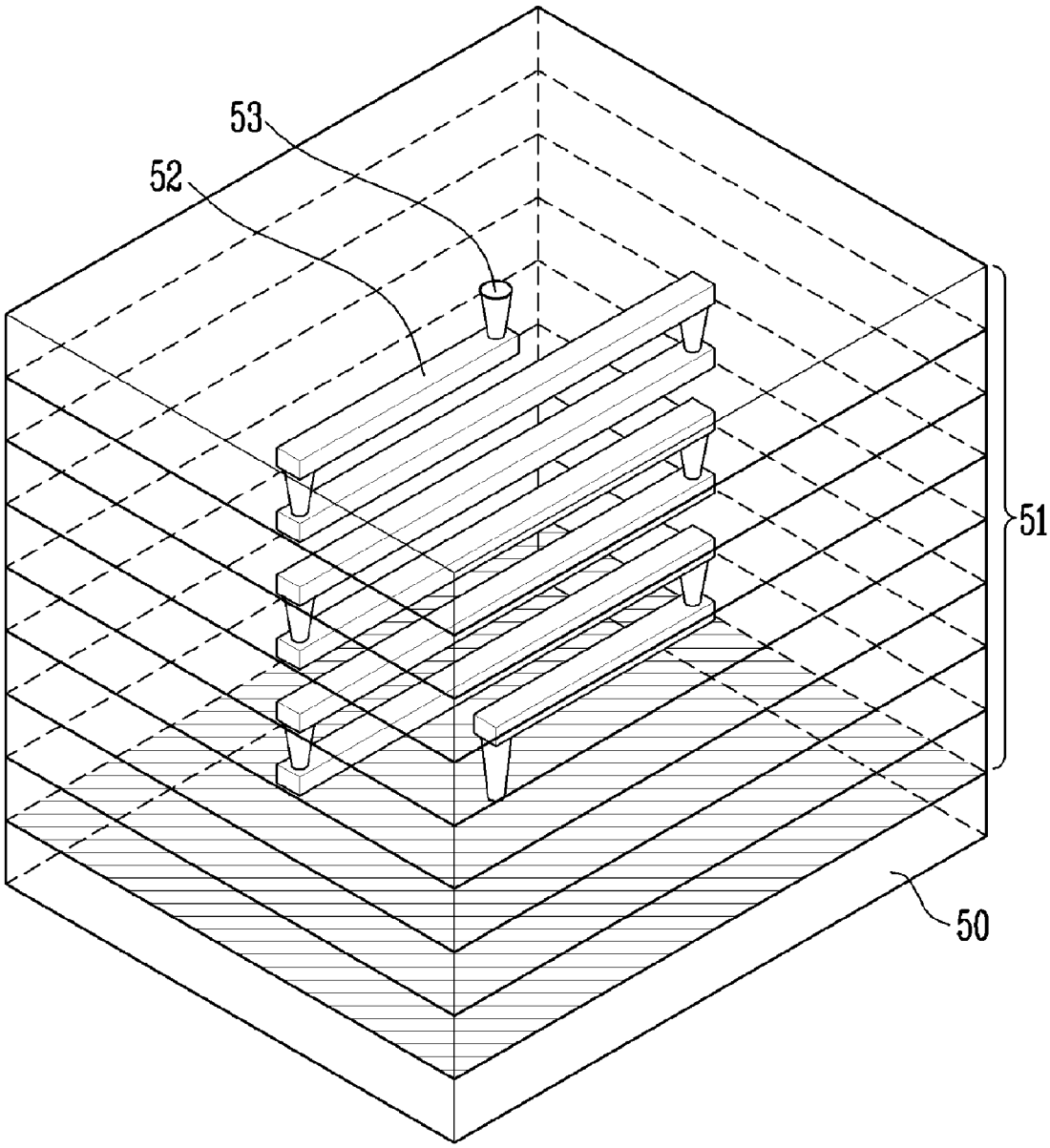
FIG. 5 is a schematic perspective view of an electronic device including a vertically formed meander inductor in accordance with a second exemplary embodiment of the present invention.

FIG. 5 is a schematic perspective view of an electronic device including a vertically formed meander inductor in accordance with a second exemplary embodiment of the present invention.

Referring to FIG. 5, the inductor in accordance with the second exemplary embodiment of the present invention has a meander shape, and includes a plurality of conductive lines 52 horizontally formed on a plurality of insulating layers 51 disposed on a substrate 50, and vias 53 for electrically connecting conductive lines 52 formed on the insulating layers 51.

Figure 6:
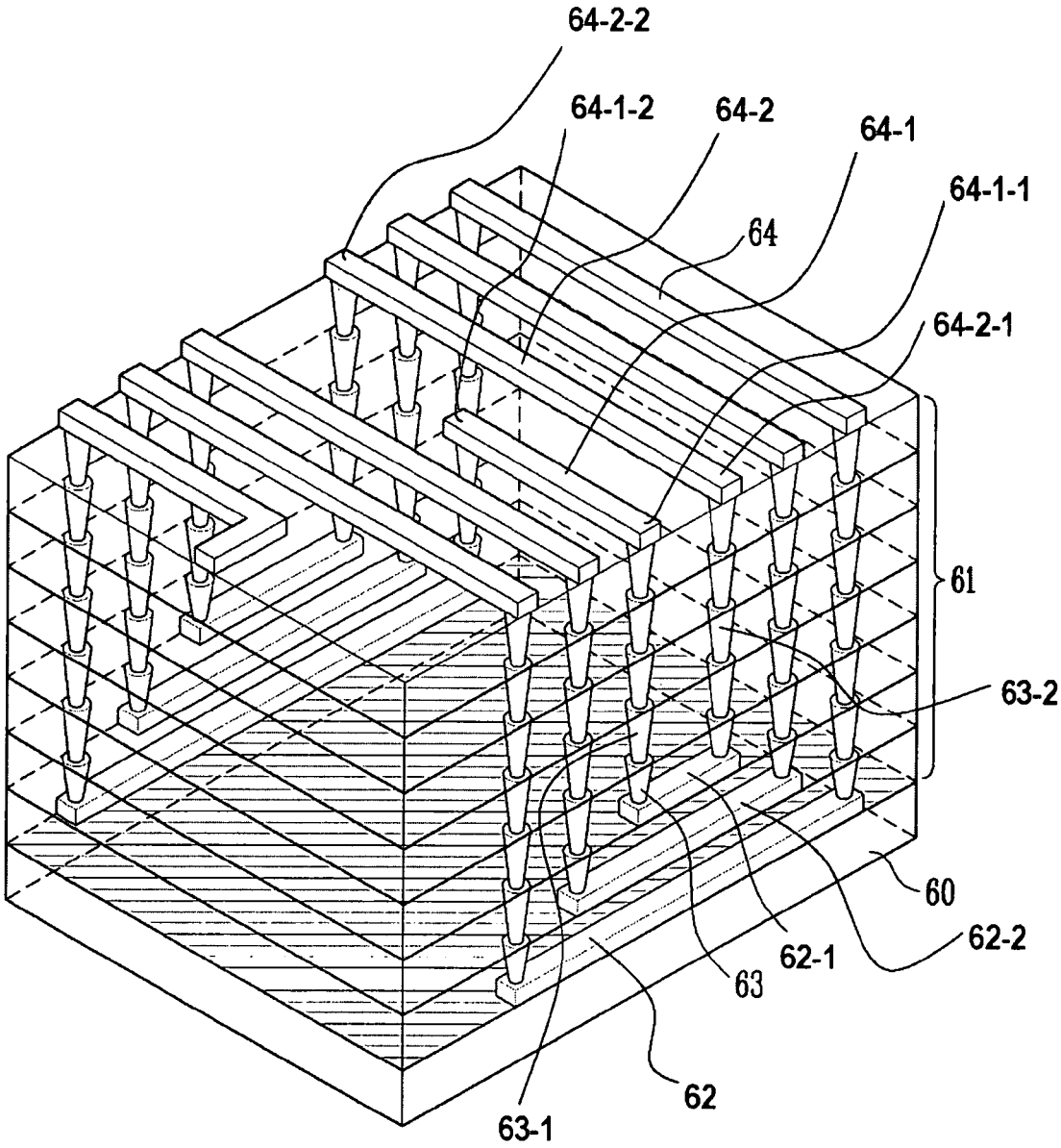
FIG. 6 is a schematic perspective view of an electronic device including a vertically and horizontally bent spiral inductor in accordance with a third exemplary embodiment of the present invention.

FIG. 6 is a schematic perspective view of an electronic device including a vertically and horizontally bent spiral inductor in accordance with a third exemplary embodiment of the present invention.

Referring to FIG. 6, the inductor in accordance with the third exemplary embodiment of the present invention is formed on an upper surface of a plurality of insulating layers 61 disposed on a substrate 60 and vertically disposed in the insulating layers 61. The inductor includes first conductive lines 62 formed on an upper surface of each of the insulating layers 61, and vias 63 for electrically connecting the first conductive lines 62. Moreover, the inductor further includes second conductive lines 64 electrically connected to the first conductive lines 62 and the vias 63, and formed on an uppermost surface of the plurality of insulating layers 61. As illustrated in FIG. 6, the second conductive lines 64, including conductive lines 64-1 and 64-2, are disposed on the uppermost surface of the insulating layers 61, whereas the first conductive lines 62, including conductive lines 62-1 and 62-2, are disposed lower than the conductive lines 64-1 and 64-2. An upper end of a via 63-1 is connected to the conductive line 64-1, a lower end of the via 63-1 is connected to a left end of the conductive line 62-1, a lower end of another via 63-2 is connected to a right end of the conductive line 62-1, and an upper end of the via 63-2 is connected to the conductive line 64-2. As further illustrated in FIG. 6, the conductive lines 62 extends in a direction perpendicular to a direction of a line that connects one end 64-1-1 of the conductive line 64-1 and the other end 64-1-2 of the conductive line 64-1, and the conductive line 62 extends in a direction perpendicular to a direction of a line that connects one end 64-2-1 of the conductive line 64-2 and the other end 64-2-2 of the conductive line 64-2. The conductive line 62-2 is disposed lower than the conductive line 62-1.

That is, when a conventional method of forming a conductive line on an upper surface of the insulating layer 61 is combined with a method of vertically forming a conductive line in the insulating layer 61 to form the inductor, as shown in FIG. 6, the inductor can be expanded in various direction of the insulating layer 61. FIG. 6 illustrates the insulating layer 61 as a cube, wherein the inductor is formed on three surfaces (the upper surface and both vertical side surfaces) of the insulating layer 61. That is, a method of constituting an inductor by rotating a conductive line in all directions of a three-dimensional space as well as a method of rotating a conductive line in only a vertical direction may be adapted. In this case, the inductor is formed on the entire surface of the insulating layer 61 to provide a space in which other components are formed in a dielectric, thereby implementing the inductor capable of maximizing spatial utilization.

According to the above embodiments, the inductor in accordance with the present invention employs a structure vertically formed on an electronic device or a board, other than formed on an upper surface of the electronic device or the board or formed in a direction parallel to the upper surface of the electronic device or the board, to occupy a minimum area on the electronic device or the board. As described above, the method of constituting a conductive line of an inductor can form the conductive line of the inductor in all direction of a three-dimensional space as well as in a single vertical direction. Moreover, in order to maximize inductance, both the conventional inductor constituting method and the inductor constituting method in accordance with the present invention can be used.

As can be seen from the foregoing, when a board or an electronic device including an inductor proposed by the present invention is manufactured, the inductor can occupy a minimum area in the electronic device or the board to provide high inductance. In particular, the surface area of the electronic device or the board occupied by the inductor can be remarkably decreased to reduce manufacturing costs.

Accordingly, a reduction in the area occupied by the inductor minimizes the area occupied by the inductor having a target inductance value on the electronic device or the board so that a space for accommodating other components except the inductor can be substantially obtained to manufacture an integrated circuit capable of maximizing spatial disposition in comparison with the conventional method. In order to implement the inductor having a desired inductance, a spiral line is formed in a cross-sectional direction of a multi-layered LTCC, without using a method of forming a spiral line in a direction of the surface of a dielectric in a multi-layered structure as a conventional method employed in a conventional LTCC process. Therefore, when the inductor is formed on the LTCC having a multi-layered surface, it is possible to minimize the area required for providing the same inductance value, thereby implementing the inductor having good spatial utilization.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. An inductor, which is vertically disposed in a plurality of insulating layers of a low temperature co-fired ceramic (LTCC) substrate, comprising:

a plurality of conductive lines disposed on the insulating layers, including a first conductive line, a second conductive line and a third conductive line; and vias vertically formed in the insulating layers to electrically connect the plurality of conductive lines, including a first via and a second via, wherein the first and third conductive lines are disposed on an uppermost surface of the insulating layers, the second conductive line is disposed lower than the first and third conductive lines, an upper end of the first via is connected to the first conductive line, a lower end of the first via is connected to a first end of the second conductive line, a lower end of the second via is connected to a second end of the second conductive line, and an upper end of the second via is connected to the third conductive line, and wherein the second conductive line extends in a direction perpendicular to a direction of a line that connects one end of the first conductive line and the other end of the first conductive line, and wherein the second conductive line extends in a direction perpendicular to a direction of a line that connects one end of the third conductive line and the other end of the third conductive line.

2. The inductor of claim 1, further comprising a third via and a fourth via, wherein:

said one end of the first conductive line is connected to the upper end of the first via and said the other end of the first conductive line is connected to an upper end of the third via;

said one end of the third conductive line is connected to the upper end of the second via and said the other end of the third conductive line is connected to an upper end of the fourth via;

the first conductive line extends linearly from said one end to said the other end of the first conductive line; and the third conductive line extends linearly from said one end to said the other end of the third conductive line.

3. The inductor of claim 1, further comprising a fourth conductive line, wherein the fourth conductive line is disposed lower than the second conductive line.

4. The inductor of claim 3, wherein the fourth conductive line extends in a direction parallel to the direction in which the second conductive line extends.

5. The inductor of claim 3, further comprising:

a fifth conductive line and a sixth conductive line, both being disposed on the uppermost surface of the insulating layers;

a fifth via for connecting one end of the fourth conductive line to the fifth conductive line; and a sixth via for connecting the other end of the fourth conductive line to the sixth conductive line.

* * * * *